US007690237B2

(12) United States Patent
Slack

(10) Patent No.: US 7,690,237 B2
(45) Date of Patent: Apr. 6, 2010

(54) RADIAL PISTON CRIMPING TOOL

(75) Inventor: Maurice William Slack, Edmonton (CA)

(73) Assignee: Noetic Technologies Inc., Edmonton (CA)

( * ) Notice: Subject to any disclaimer, the term of this patent is extended or adjusted under 35 U.S.C. 154(b) by 285 days.

(21) Appl. No.: 11/837,444

(22) Filed: Aug. 10, 2007

(65) Prior Publication Data

US 2008/0034832 A1 Feb. 14, 2008

Related U.S. Application Data

(60) Provisional application No. 60/837,394, filed on Aug. 11, 2006.

(51) Int. Cl.
*B21D 41/00* (2006.01)
*B23P 19/04* (2006.01)

(52) U.S. Cl. ..... 72/402; 29/237

(58) Field of Classification Search ..... 72/370.12, 72/402, 409.19, 413, 416, 446, 448, 481.1, 72/482.91, 482.5
See application file for complete search history.

(56) References Cited

U.S. PATENT DOCUMENTS 3,662,450 A * 5/1972 Kish et al. ..... 29/237
5,069,058 A 12/1991 Hyatt
6,199,254 B1 3/2001 Suresh
6,405,411 B1 * 6/2002 Allemann et al. ..... 24/19

* cited by examiner

*Primary Examiner*—Dana Ross
*Assistant Examiner*—Teresa M Bonk
(74) *Attorney, Agent, or Firm*—Christensen O'Connor Johnson Kindness PLLC

(57) ABSTRACT

A crimping tool is disclosed that includes a housing assembly carrying a crimping assembly having jaws with engagement surfaces designed to move in the radial direction under controlled load and controlled displacement with application of hydraulic pressure to pistons provided to load the jaws. The crimping tool is designed to be separable into two parts, which facilitates assembly and disassembly of the tool around the work piece for crimping at locations remote from the end of a continuous or long section of pipe. This tool is adapted for use in crimping end fittings onto composite pipe and for use in a field environment where the tool is manually transportable.

8 Claims, 9 Drawing Sheets

RADIAL PISTON CRIMPING TOOL

CROSS-REFERENCE TO RELATED APPLICATION

This application claims the benefit of U.S. Provisional Application No. 60/837,394, filed on Aug. 11, 2006, the disclosure of which is expressly incorporated by reference.

FIELD

The present application relates generally to applications where metal fittings are crimped to fiberglass/plastic composite pipes. In the field of crimping, this invention relates particularly to applications where long lengths or spools of such composite pipe are field joined by a crimped connection.

BACKGROUND

Pipelines are commonly used to connect individual petroleum wells to more central facilities. Historically these pipelines, or so called gathering lines, have been constructed from lengths of steel pipe, field assembled by welding. In certain applications, where pressure and temperature requirements permit, the use of steel pipe is being replaced by composite plastic/fiberglass pipe. This composite pipe is field supplied in spools of considerable length, greatly reducing the number of field joins required and providing other advantages such as flexibility and corrosion resistance. Nonetheless, while the number of joins is reduced, field joining between the ends of pipe lengths is still required as are connections of the pipe to other elements of the pipeline system. Thus effecting connections at the ends of composite pipes having a high degree of structural and leakage integrity are required. One method or type of connection is made by crimping a fitting to the end of a length of pipe.

SUMMARY

Accordingly, there is provided a crimping tool. The crimping tool comprises a split housing assembly made from a suitably strong and rigid material having a central passageway to accommodate a tubular work piece. The split housing has at least two main body components. The main body components include a structurally rigid joining mechanism. The rigid joining mechanism enables the at least two main body components of the split housing to be separately placed around a tubular work piece and joined to form a generally short thick-walled cylindrical frame enclosing or encircling the work piece. The joining mechanism also enabling the split housing to be separated and removed from the work piece. A crimper assembly is carried by the housing assembly. The crimper assembly has three or more jaws arranged to radially extend and retract. The jaws each carrying a discrete portion of a crimping surface generally shaped to conform to the work piece and positioned to radially engage the outside surface of the work piece when the split housing is placed around the work piece and joined. The crimping assembly has means to apply a selected proportion of radial force to each of the jaws, correlatively providing proportionally distributed radial inward crimping load to the crimping surface. The number of jaws can be selected to distribute portions of the crimping surface according to the needs of the application to accommodate non-axi-symmetric features of the work piece, and the distribution of force can be selected to arrange for controlled radially distributed substantially uniform loading of the jaws or other distribution as may be desirable for a given application.

BRIEF DESCRIPTION OF THE DRAWINGS

These and other features will become more apparent from the following description in which references are made to the following drawings. The drawings are for the purpose of illustration only and are not intended to in anyway limit the scope of the invention to the particular embodiment shown.

DETAILED DESCRIPTION OF THE PREFERRED EMBODIMENTS

General Principles

Figure 1:
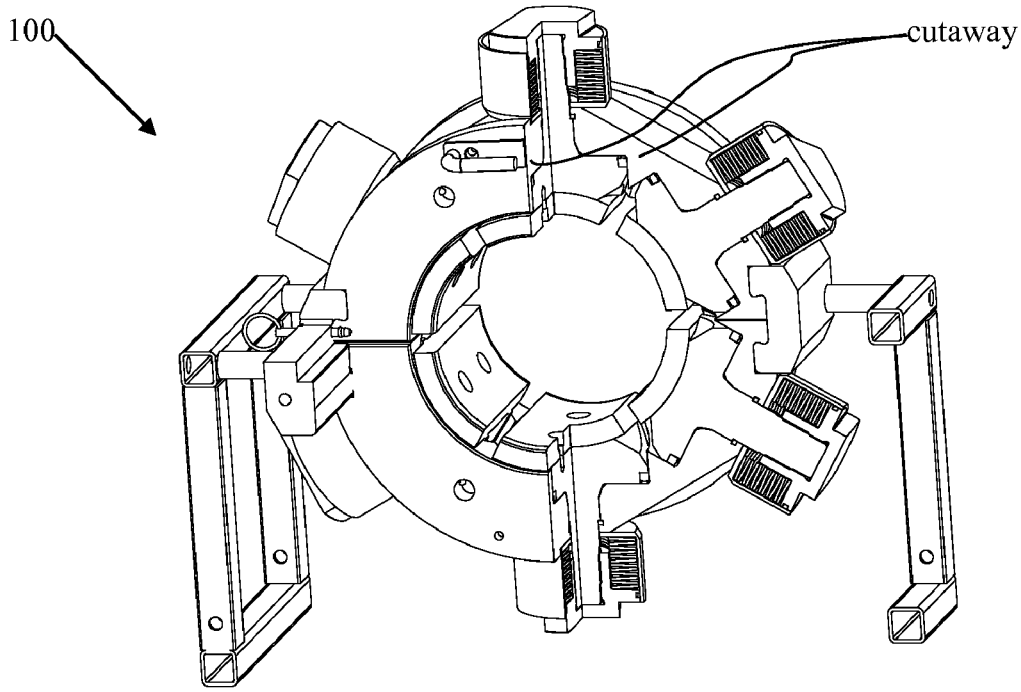
FIG. 1 is an isometric partial cutaway view of a crimping tool with internally located pistons, shown in its retracted position as it would appear with no fluid pressure applied.

Crimping is a well known method of fastening metal fittings to hose or pipe having a tubular wall made of more flexible materials such as elastomers or plastic. Typically the metal fitting is coaxially arranged at the end of a hose having an internal support tube placed inside and close fitting with the hose bore and an external ductile sleeve placed outside and close fitting with the exterior surface of the hose forming an annular space filled or largely filled by the hose wall material. This coaxial assembly of fitting and hose or pipe is herein generally referred to as the work piece. In axi-symmetric terms, the crimping method can be explained as a process where sufficient radial or crimping force is applied to the outside of the work piece by a crimping tool causing the ductile sleeve to plastically deform and displace inward in contact with the hose, and upon sufficient displacement induces a through thickness radial stress in the hose wall material correlative with its confinement or interference fit inside the annular space formed between the support tube and ductile sleeve. Upon release of the crimping force, the elastic rebound of the annulus thickness defined by the metal support tube and sleeve components is less than that through the thickness of the confined hose wall material resulting in a residual mechanically induced 'shrink fit' stress state. The resulting radial contact forces acting between the hose and fitting surfaces act to directly resist leakage of pressured fluid contained by the hose and mobilize frictional resistance to slippage providing resistance to structural loads enabling axial, bending, shear or torsional forces to be reacted across the fitting and hose.

However, according to the teaching of the present invention, this simple axi-symmetric explanation fails to distinguish the effects of non-axi-symmetric variables present in the work piece or introduced by the configuration of the crimping tool. Where these effects result in variations in radial stress, such variations can adversely affect the sealing, and possibly also the structural capacity of the crimped connection.

Crimping tools known to the art, typically do not embody a crimping process that applies the crimping force as a circumferentially uniform (axi-symmetric) radial pressure to the outside of the work piece, instead the prior art crimping tools apply the radial force through two or more jaws configured to each carry a segment of a crimping surface that together largely conforms to and encloses the exterior surface of the work piece interval to be crimped.

Where such crimping tools employ two such jaws, the jaws are typically arranged to each carry one half of the crimp surface and be in opposition to each other, so that the force applied by one jaw is equally and oppositely reacted by the other, i.e., the force applied by each jaw is equal; however this arrangement will be seen to result in radial displacement of the jaw surfaces, and correlatively change in annular thickness, that varies with relative circumferential position on the work piece, where this variation can be described as having two lobes. It will be appreciated that this variation in radial displacement tends to result in through wall interference variations where the correlative variations in residual radial stress increase with stiffness of the hose wall material.

Where crimping tools employ more than two jaws, the jaws are typically arranged as a set of linked wedges, vis. a collet, where a common increment of axial displacement results in a proportional increment of radial displacement that is the same for each of the jaws. In this configuration, where the radial displacement is controlled, the radial force applied by each jaw is a dependent variable and depends on the local radial resistance presented by the work piece at the circumferential location of each jaw. Thus where the resistance offered by the work piece varies circumferentially, the resulting residual radial stress of a crimped connection may vary. It will be appreciated that this variation is dependent in part on variations in initial thickness and radial stiffness present in the hose or tube of the crimped work piece. As for crimping methods employing two jaws, it will thus be seen that crimped connections formed by this second method using displacement control of three or more jaws, are more susceptible to localized reductions in radial stress for hose material having greater stiffness or greater circumferential variations in wall thickness. These prior art methods have thus found broad application in applications where the hose wall is constructed of a low stiffness material such as an elastomer.

The hose wall used in gathering lines is a composite structure of plastic and fiberglass layers. The through wall radial stiffness is thus relatively high, compared to more commonly understood reinforced elastomeric hose. Furthermore, the final wall thickness may vary around the circumference as a function of various manufacturing process variables. This combination of relatively high radial stiffness and thickness variation makes the crimped connection susceptible to the circumferential variations in radial stress allowed by these prior are methods. In contrast, the method incorporated into crimping tools made according to the teachings of the present invention applies a proportionally selected radial load to a plurality of jaws and is thus adapted to compensate for such local variations in thickness. In addition, these tools are provided with means to allow assembly around a work piece enabling lateral removal of the crimping tool from the work piece in applications where removal would otherwise be difficult or impossible, as for example, where the work piece joins two long sections of pipe so that removal, if possible at all, would otherwise require the crimping tool to be moved axially to the end of one of the long joined pipe segments.

There will now be described in detail two (2) particular crimping tool configurations embodying the method of the present invention, each with two (2) alternative embodiments.

Internal Piston Radial Tubular Forming Load Controlled Crimping Tool

Figure 2:
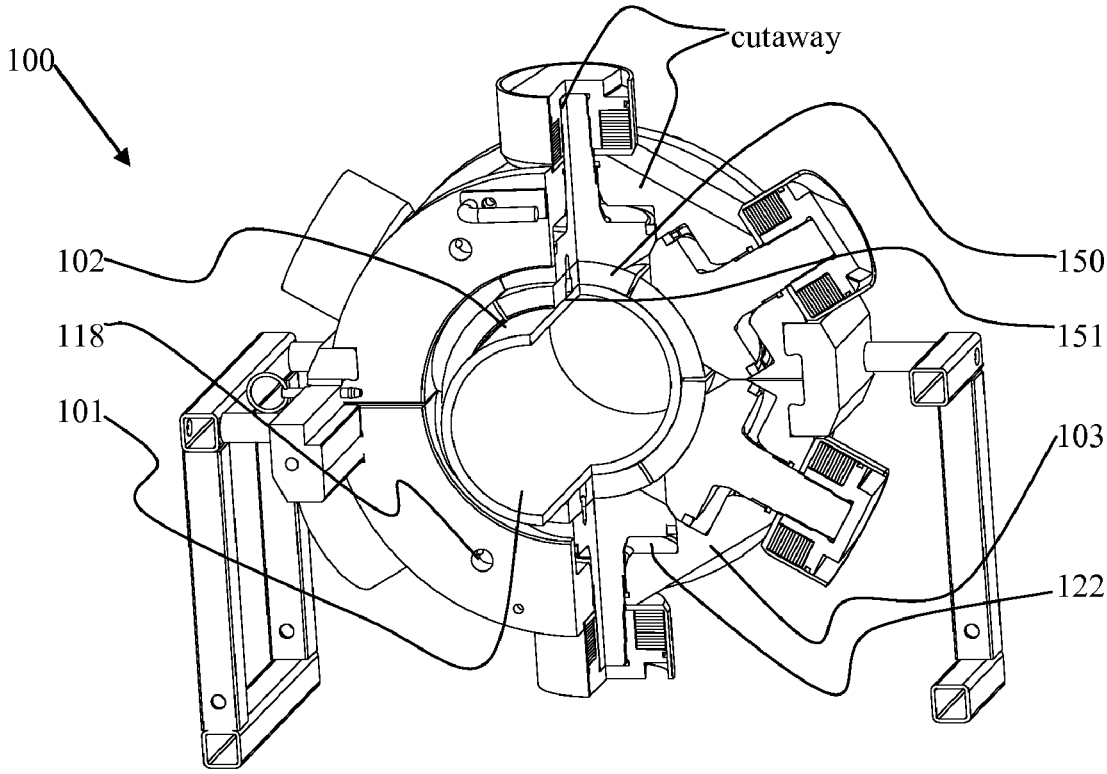
FIG. 2 is an isometric partial cutaway view of the crimping tool with internally located pistons, shown in its engaged position as it would appear with fluid pressure applied, causing the dies to engage to a work piece.

Referring to FIGS. 1 though 6, a preferred embodiment of the crimping tool is shown that provides optimized weight and portability. This tool will be referred to here as an internal piston crimping tool. It is shown in FIG. 1 and generally designated by the numeral 100, where it is shown in an isometric partial cutaway view as it would appear with no applied fluid pressure. Referring now to FIG. 2, the internal piston crimping tool 100 is shown in an isometric partial cutaway view as it would appear with fluid pressure applied to the fluid chambers and the resulting contact between dies 150 and a work piece 101.

Figure 3:
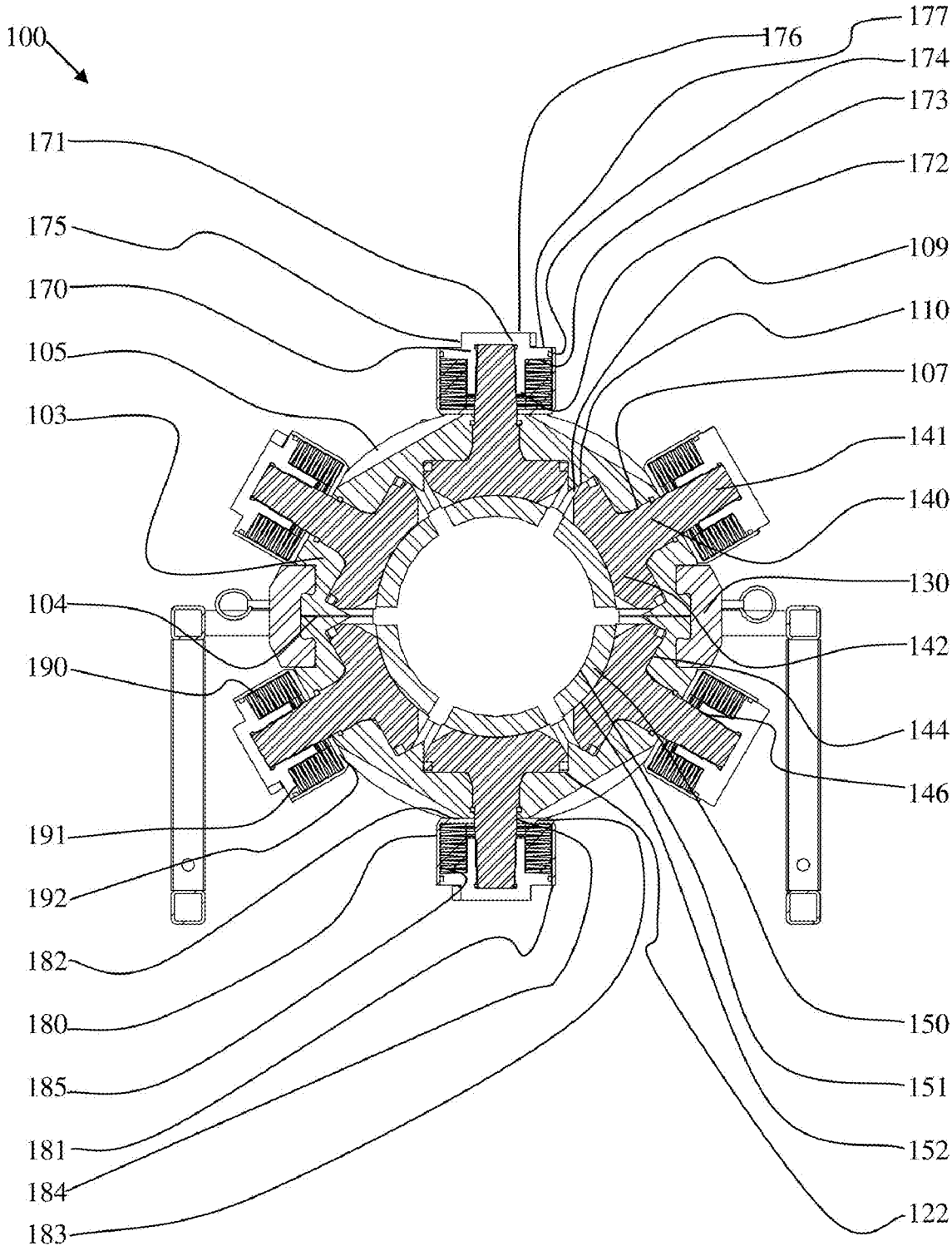
FIG. 3 is a cross-section view of the crimping tool with internally located pistons shown in its retracted position as it would appear with no fluid pressure applied.
Figure 4:
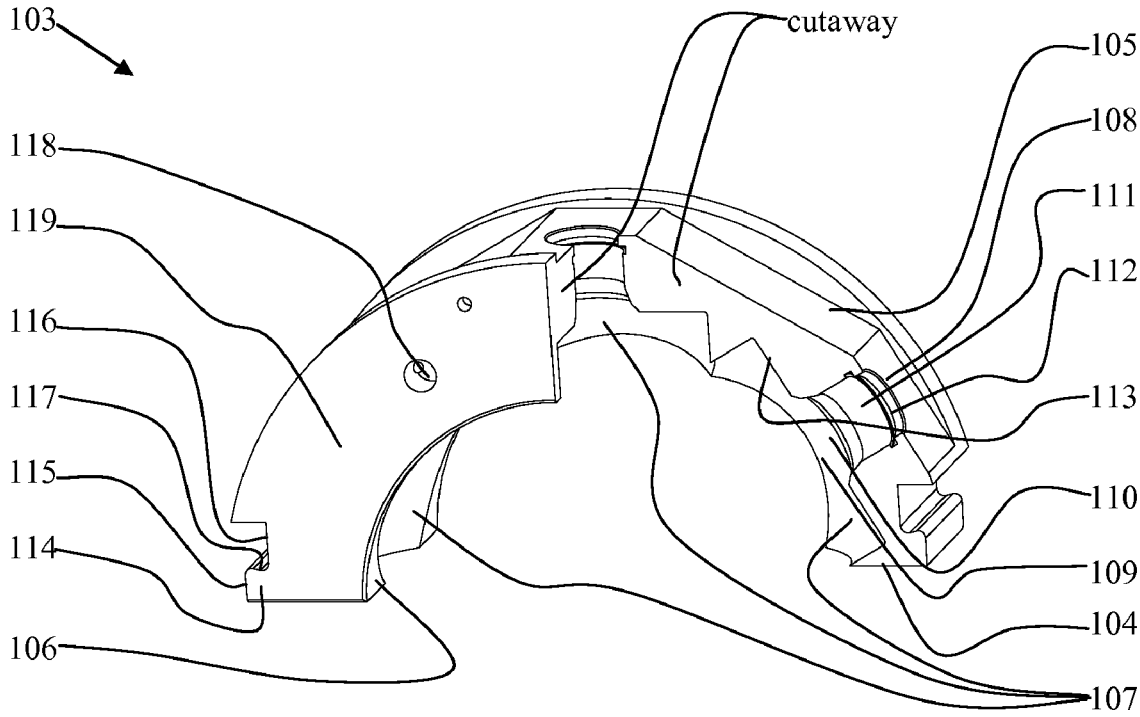
FIG. 4 is an isometric partial cutaway view of a piston-housing, for use with the crimping tool with internally located pistons.

Referring now to FIG. 3, the internal piston crimping tool 100 is shown in a cross-section view as it would appear with no fluid pressure applied. The internal piston crimping tool 100 has two (2) identical piston housings 103 each with a generally semi-cylindrical shape arranged in an opposing manner with the bottom faces 104 located next to one another so that together they form generally cylindrical tool. It will be understood that there may be additional piston housings 103 that, when combined, for a generally cylindrical tool as shown. FIG. 4 shows an isometric partial cutaway view of a piston housing 103, with bottom face 104, generally semi-cylindrical outer surface 105, and inner bore 106, that has a plurality of piston bores 107, in this case three (3), oriented in the radial direction. The piston bores 107 have identical bore profiles and are evenly spaced in a radial plane, in this case sixty (60) degrees from one another, at the centre-point of the internal piston crimping tool. Piston bore 107 with an outer end 108 and an inner end 109, has a cylindrical section 110 at its inner end 109 and generally cylindrical section 111 including a seal 112 at its outer end 108. The piston bore 107 has inward facing shoulder 113 that separates the inner cylindrical section 110 from the outer cylindrical section 111.

Figure 5:
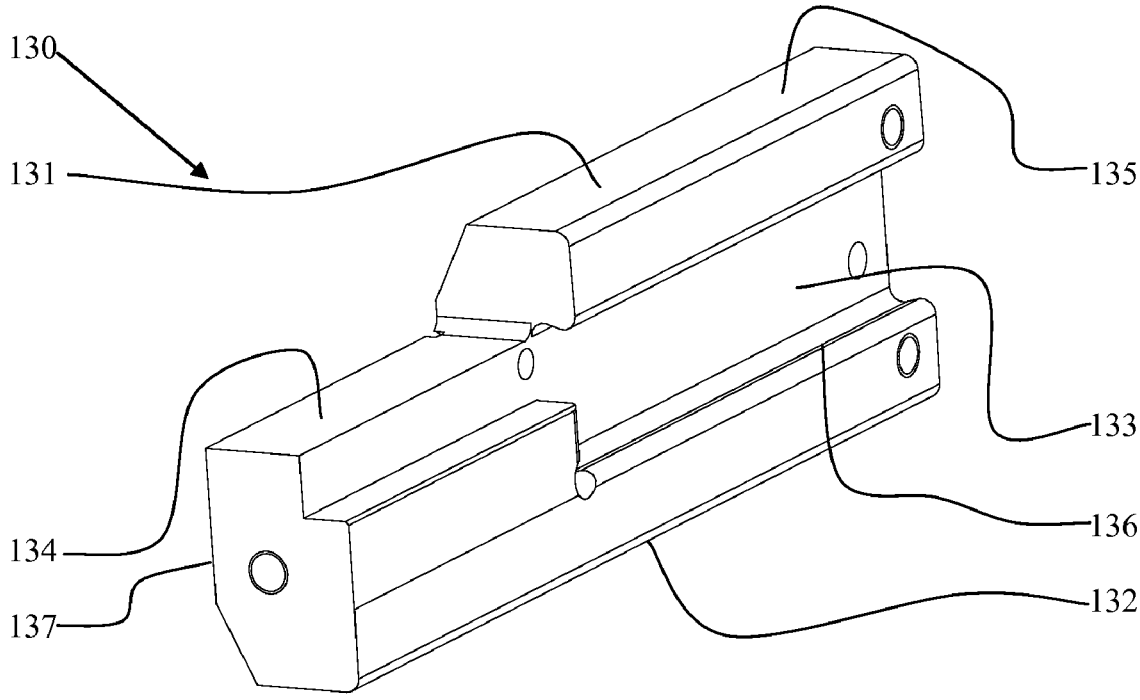
FIG. 5 is an isometric view of a lock guide bar, for use with the crimping tool with internally located pistons.

Referring again to FIG. 4, piston housing 103 has two (2) lock-guide rails 114 located on opposing sides and adjacent to the bottom face 104. Lock-guide rail 114 has an outer face 115 and inner face 116 separated by a tapered "dove-tail" profile 117. Referring now to FIG. 3, the internal piston crimping tool 100 has two (2) lock-guide bars 130 with identical but mirrored geometry. Referring now to FIG. 5, which shows an isometric view of a lock-guide bar 130, lock-guide bar 130 has a generally elongate shape, having upper end 131, lower end 132, inner stepped surface 133 and outer face 137. The inner stepped surface 133 of lock-guide bar 130 has a tapered "dove-tail" profile 136. Referring again to FIG. 3, the inverse of the tapered "dove-tail" profile 136 is tapered "dove-tail" profile 117 on lock-guide rail 114 of piston housings 103. Lock-guide bar 130 slidingly engages with lock-guide rail 114 on both piston housings 103 and attaches the piston housings 103 to one another. Referring again to FIG. 5, the front end 134 of the lock-guide bar 130 has a reduced section and acts as a guide rail to aid assembly of the two piston housings 103. The back end 135 of lock-guide bar 130 has the fully profiled "dove-tail" shape 136.

Referring again to FIG. 4, the piston housing 103 has a plurality of external fluid ports 118, in this case two (2), on the front face 119, located equidistance from two (2) adjacent piston bores 107. Each fluid port 118 runs perpendicular to the front face 119 of the piston housing 103, a secondary duct connects this port to inward facing shoulder 113 of piston bore 107. In conjunction with one another, fluid ports 118 combine to provide fluid interconnectivity between all piston bores 107 in each piston housing 103, the interconnectivity ensures identical fluid pressure in all fluid chambers 122 while allowing independent displacement of piston 140. It is understood that the piston housing 103 is not limited to this arrangement of fluid ports, alternatively independent fluid ports could be provided for each fluid chamber and hose connections external to the tool could allow for either independent or interconnected fluid chambers as may be desirable for a given application.

Figure 6:
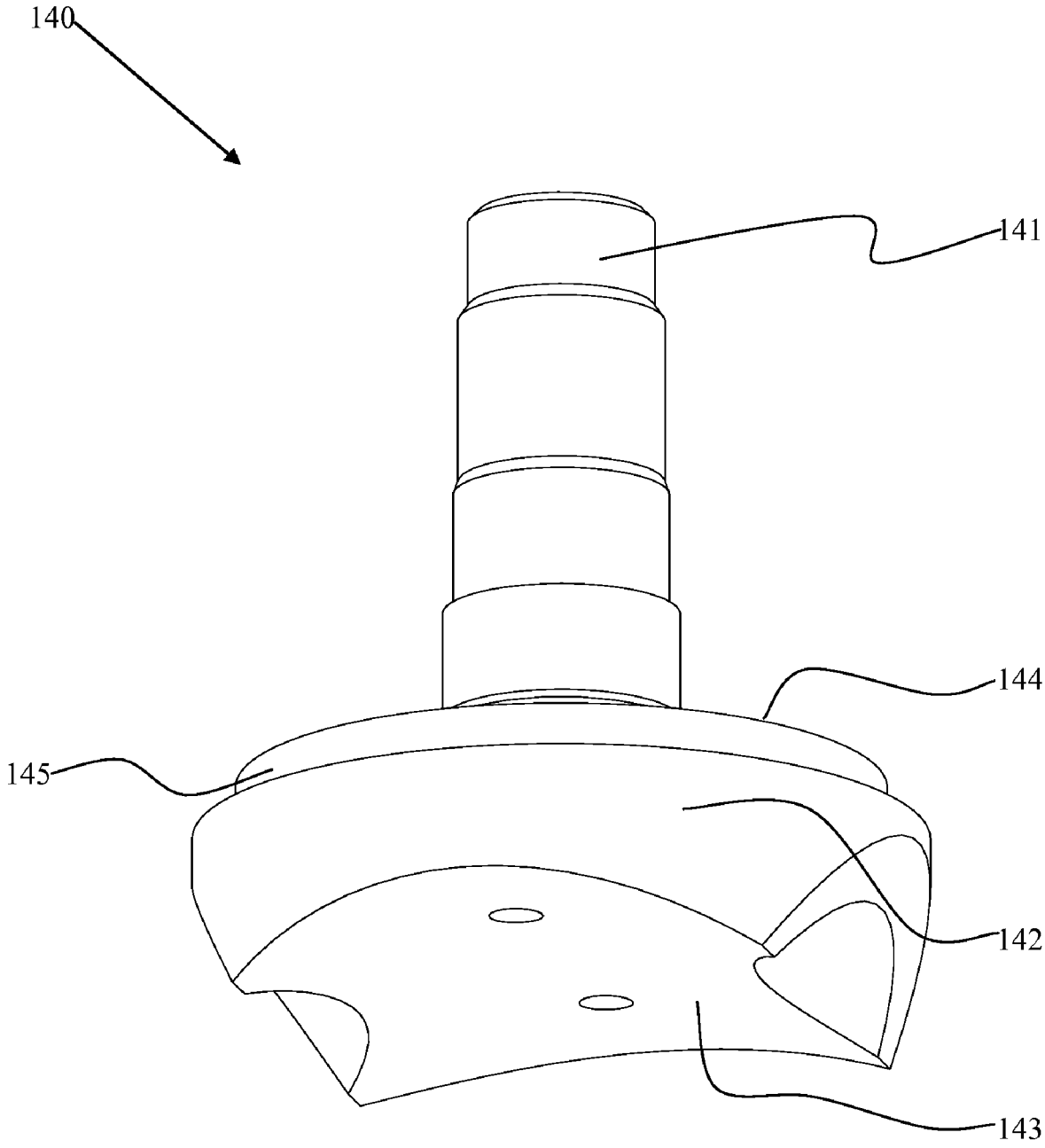
FIG. 6 is an isometric view of a piston, for use with the crimping tool with internally located pistons.

Referring again to FIG. 3, the internal piston crimping tool, crimping assembly has a plurality of piston assemblies, in this case six (6) identical assemblies, each of which includes the following components: a piston 140, a die 150, a piston nut 170, a spring can 180 and a spring 190. In this case the pistons assemblies are arranged in a plane at the centre-line of the internal piston crimping tool and spaced at even radial intervals, in this case sixty (60) degrees. It is understood that the piston assemblies are not limited to being identical and evenly spaced, and that in the preferred embodiment of the invention the size and spacing of the piston assemblies may be varied within a crimping tool to accommodate circumferential variations in the required applied load distribution to a work piece. Piston 140 is located coaxially in piston bore 107 of piston housing 103. Referring now to FIG. 6, which is an isometric view of piston 140, with upper end 141 and lower end 142, piston 140 has a cylindrical lower face 143, an upward facing shoulder 144, and a seal 145. Referring again to FIG. 3, piston 140 aligns concentrically with piston bore 107 in the piston housing 103. The cylindrical surface 146 on the upper end of piston 140 sealingly and slidingly engages with the seal 112 on piston housing 103. Seal 145 on the lower end 142 of piston 140 slidingly and sealingly engages with the cylindrical surface 110 at the inner end 109 of piston bore 107 in piston housing 103. The upper end 141 of the piston 140 protrudes through the outer surface 105 of the piston housing 103. The outer end 141 of the piston 140 threadingly engages with lower end 172 of piston nut 170.

Referring still to FIG. 3, piston nut 170 with upper end 171, lower end 172, downward facing shoulder 173, and seal 174, has two (2) opposing torque application faces 175 on the upper end 171. The seal 174 on the outside diameter of piston nut 170 sealingly and slidingly engages the inside diameter 185 of spring can 180.

Referring still to FIG. 3, the spring can 180 with upper face 181 and an lower face 182, is generally cylindrical in shape and hollow and has a plate 183 at the lower end with concentrically located hole 184, which is large enough to accommodate the upper end 141 of piston 140. The lower face 182 of the spring can 180 is located next to the outside surface 105 of the piston housing 103. With application of hydraulic pressure to fluid chamber 122, piston 140 is stroked fully inwards and the outer face 176 of piston nut 170 becomes flush with the outside face 181 of spring can 180. With no hydraulic pressure applied, piston 140 is stroked fully in the outward direction and the upward facing shoulder 144 of the piston 140 seats against the inward facing shoulder 113 of piston housing 103, in this position the upward facing shoulder 177 of piston nut 170 becomes flush with the upper face 181 of spring can 180.

Referring still to FIG. 3, spring 190 with upper end 191, and lower end 192, is generally tubular in shape. (The springs are shown as a Belleville washer stack in all figures, but are not limited to this design, which provides a continually increasing load with axial compression). Upper end 191 of the spring 190 seats against the downward facing shoulder 173 of the piston nut 170. Lower end 192, of the spring shoulders against the upper face of plate 183 on the lower end of the spring can 180. The spring reacts between the piston 140 and the piston housing 103 to return the piston 140 to its full outward stroke with no applied fluid pressure.

Referring still to FIG. 3, the die 150, with inside cylindrical face 151 has outside cylindrical face 152 which is rigidly attached to lower cylindrical face 143 of piston 140. Referring now to FIG. 2, activation of the internal piston crimping tool with pressure causes the inside cylindrical face 151 of the die 150, to make contact with the outside face 102 of the work piece 101. The inside face 151 of the die 150 is designed to provide a generally uniform contact with the outside surface 102 of the work piece 101 when fluid pressure is applied to fluid chamber 122.

Figure 7:
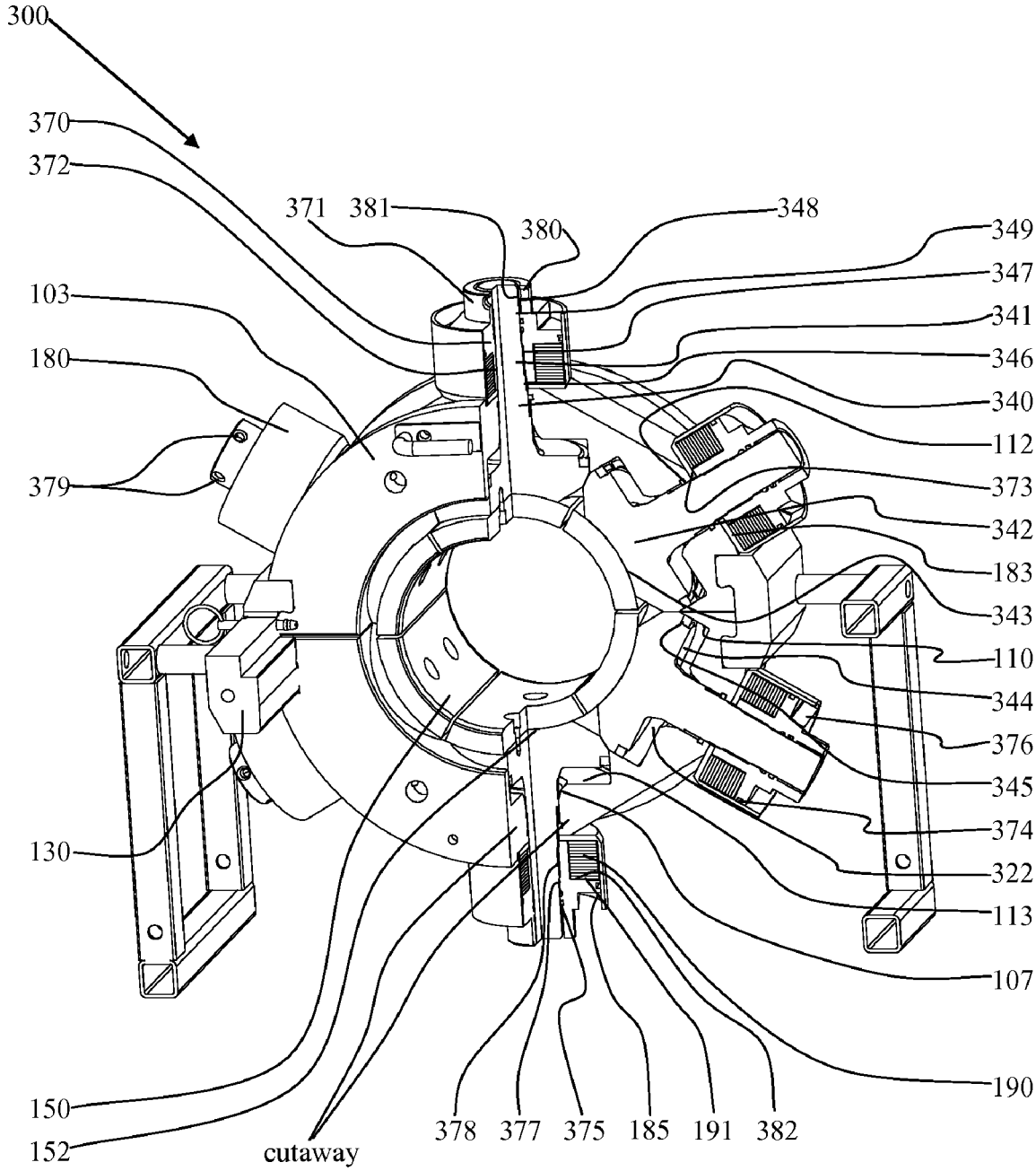
FIG. 7 is an isometric partial cutaway view of an alternative embodiment of a crimping tool with internally located pistons, shown in its extended position as it would appear with fluid pressure applied, and including a variable radial piston displacement control.

Alternative Embodiment of the Internal Piston Radial Tubular Forming Load Controlled Crimping Tool with Variable Radial Piston Displacement Control Referring to FIG. 7, an alternative preferred embodiment of the crimping tool is shown that provides optimized weight and portability in combination with variable radial piston displacement control. This tool will be referred to here as an internal piston crimping tool with displacement control. It is shown in FIG. 7 and generally referred to by the numeral 300. Referring now to FIG. 7, the internal piston crimping tool with displacement control is shown in its extended position as it would appear with fluid pressure applied. This embodiment of the crimping tool has piston housings 103, lock guide bar 130, spring can 180, die 150 and spring 190 in common with internal piston crimping tool generally referred to by the numeral 100 and illustrated in FIGS. 1 through 6.

Referring still to FIG. 7, this embodiment of the crimping tool has a plurality of pistons 340, in this case six (6), which are generally cylindrical in shape with a stepped profile. Piston 340, with upper end 341 lower end 342, has lower cylindrical face 343, upward facing shoulder 344 and seal 345. The upper end 341 of piston 340 has a smooth face 346, thread element 347, smooth face 349, and slot 348 which is oriented along the axis of the piston 340 and intersects face 346. Piston 340 is assembled in piston bore 107 of piston housing 103 forming fluid chamber 322 between the outward facing shoulder 344 of piston 340 and the inward facing shoulder 113 of piston housing 103. Seal 345 sealingly and slidingly engages face 110 of piston housing 103, and seal 112 of piston housing 103 sealingly and slidingly engages face 346 of piston 340. Lower cylindrical face 343 of piston 340 rigidly attaches to the outside face 152 of die 150.

Referring still to FIG. 7, this embodiment of the crimping tool has piston nut 370 with upper end 371, lower end 372, a radial stop in the form of downward facing shoulder 373, seal 374, and opposing torque reaction faces 376 on upper end 371. Upper end 371 of piston nut 370 has a plurality of threaded holes 379, in this case four (4), which are equally spaced on a radial plane. Piston nut 370 has internal bore 377, with thread element 378 and seal 375 at upper end 371. Downward facing shoulder 382 of piston nut 370 reacts against the upper end 191 of spring 190. The upper end 341 of piston 340 is assembled coaxially in the internal bore 377 of piston nut 370, spring 190 and spring can 180. Thread element 347 of piston 340 threadingly engages with thread element 378 of piston nut 370. Seal 375 of piston nut 370 sealingly and slidingly engages face 346 of piston 340, while seal 374 slidingly and sealingly engages the inside face 185 of spring can 180

Referring still to FIG. 7, a threaded screw 380 threadingly engages one of the threaded holes 379 on the upper end 371 of piston nut 370. The inward facing end 381 of threaded screw 380 engages slot surface 348 of piston 340 to prevent relative movement between piston 340 and piston nut 370. By removing threaded screw 380 and adjusting the position of piston nut 370 up or down along the axis of piston 340 and then reassembling threaded screw 380, the axial displacement of the piston 340 is constrained in increments related to the pitch of thread element 378 and the number of threaded holes 379, such that when pressure is applied to fluid chamber 322 the radial displacement of pistons 340 is restricted as downward facing shoulder 373 of piston nut 370 contacts the upper surface of plate 183 of spring can 180 and reacts the pressure load on piston 340.

External Piston Radial Tubular Forming Load Controlled Crimping Tool

Figure 8:
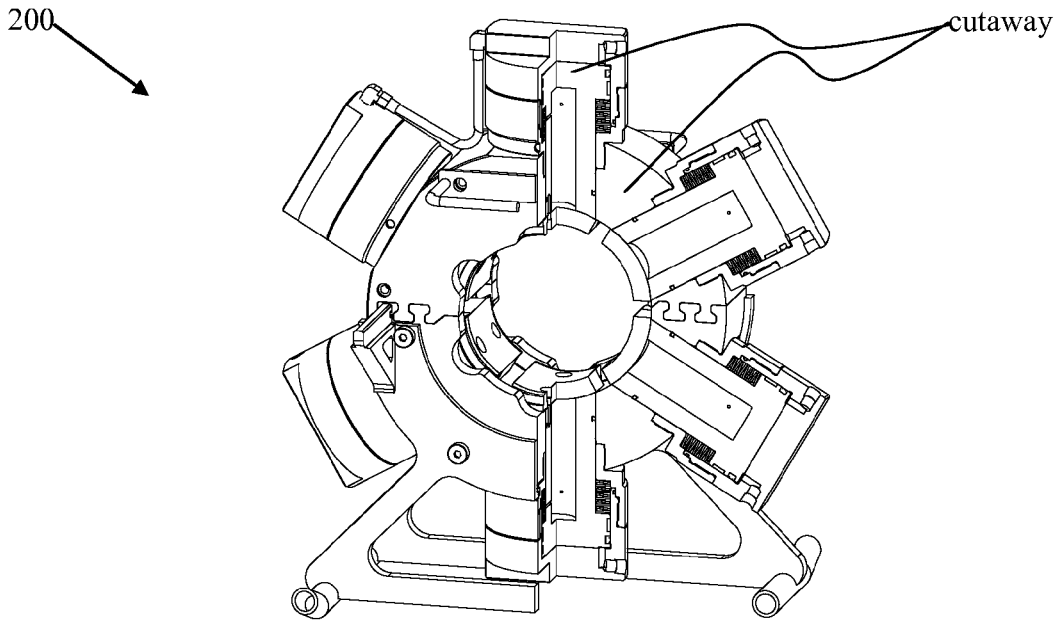
FIG. 8 is an isometric partial cutaway view of a crimping tool with externally located pistons, shown in its retracted position as it would appear with no fluid pressure applied.

Referring to FIGS. 8 though 12, there will now be described an alternative preferred embodiment of the crimping tool. This embodiment of the crimping tool provides enhanced load capacity, piston stroke, maintainability and functionality. This tool will be referred to here as an "external piston crimping tool". The external piston crimping tool is shown in FIG. 8, and generally designated by the numeral 200, where it is shown in an isometric partial cutaway view as it would appear with no applied fluid pressure. Now referring to FIG. 9, the external piston crimping tool 200 is shown as it would appear with fluid pressure applied and the resulting contact between dies 260 and a work piece 201

Figure 10:
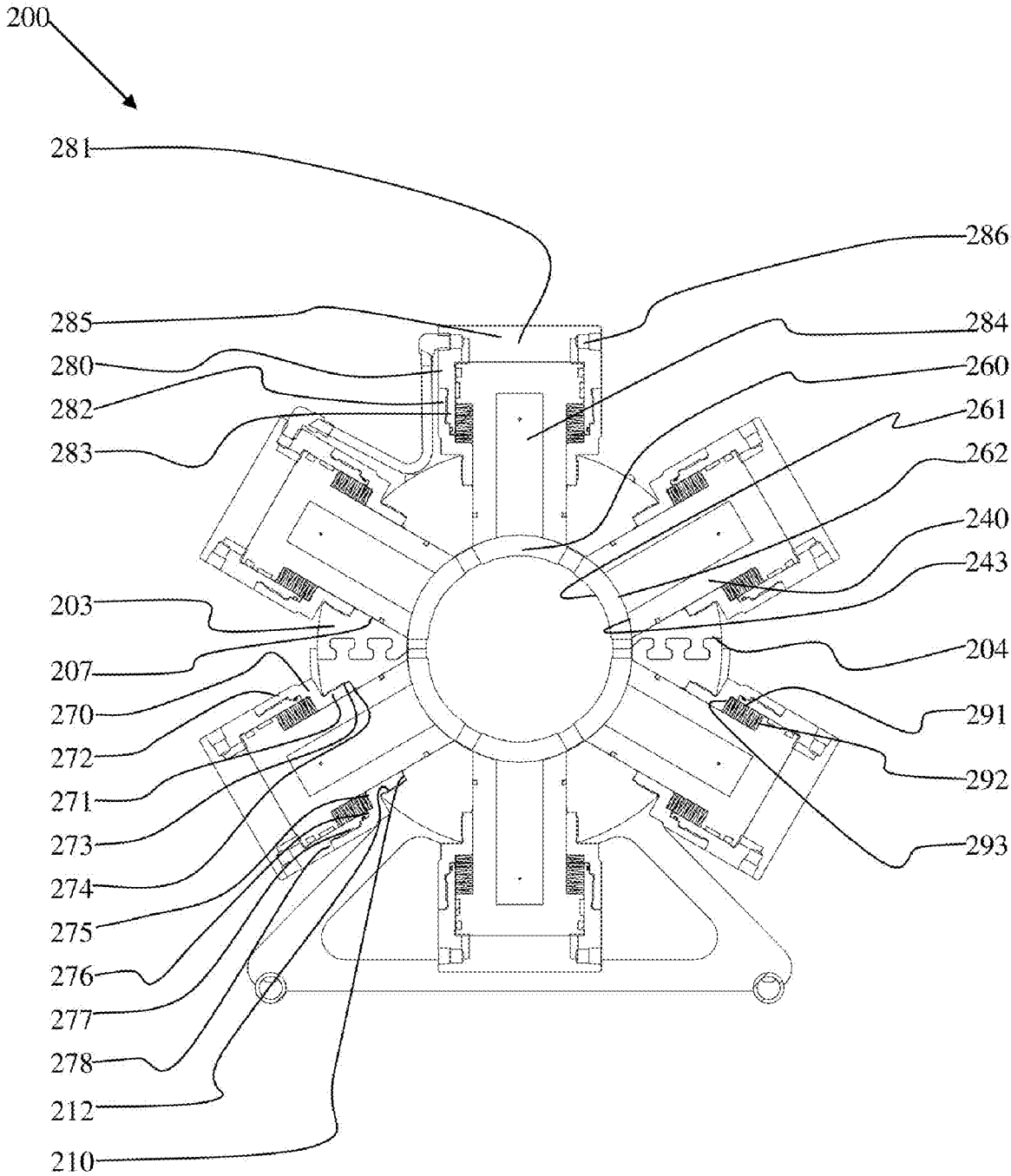
FIG. 10 is a cross-section view of the crimping tool with externally located pistons, shown in its retracted position as it would appear with no fluid pressure applied.
Figure 11:
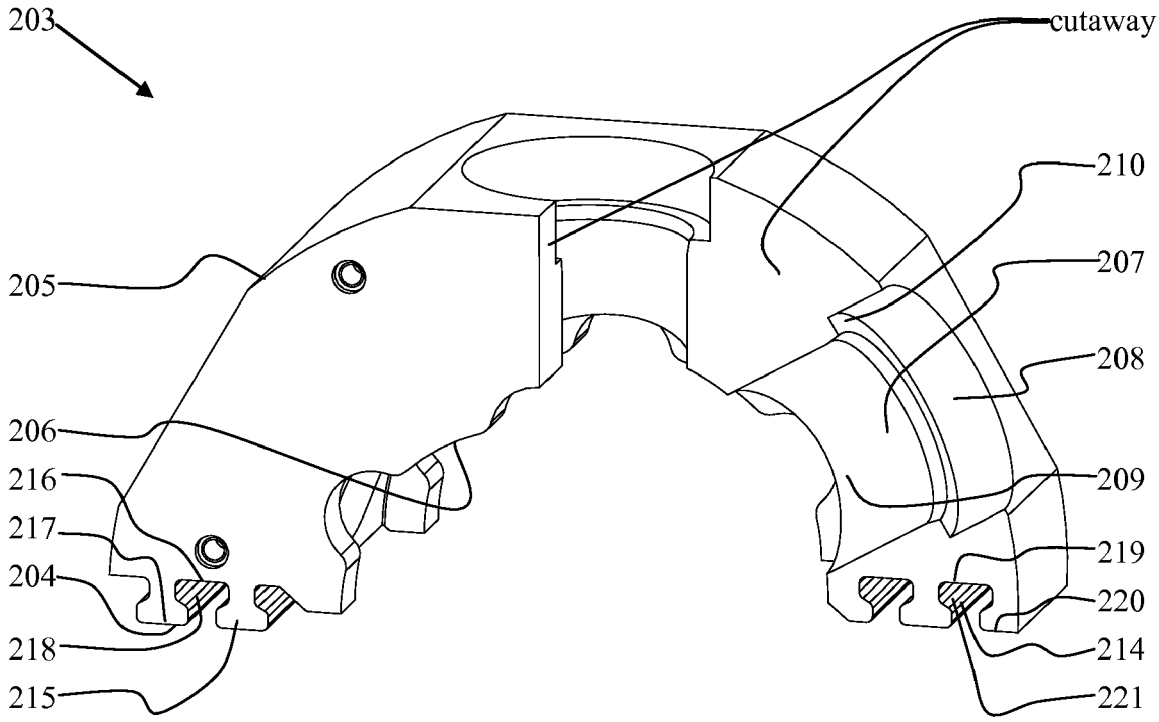
FIG. 11 is an isometric partial cutaway view of a piston-housing, for use with a crimping tool with externally located pistons.

Referring now to FIG. 10, the external piston crimping tool 200 is shown in a cross-section view as it would appear with no fluid pressure applied. The external piston crimping tool 200 has two (2) piston housings 203 with a generally semi-cylindrical shape which are arranged in an opposing manner with the lower faces 204 located adjacent to one another so that together they form a generally cylindrical tool. Piston housings 203 are connected using an interlocking engagement, which is separable in a substantially axial direction and resists separation in other directions. In the depicted embodiment, piston housing 203 has a plurality of T-slot or dovetailed keys 214 and 215 on its bottom face 204 which when assembled are arranged so that they mate with the opposite face on the other piston housing 203. It will be recognized that various interlocking engagements are possible. Referring now to FIG. 11 which shows an isometric partial cutaway view of piston housing 203, with bottom surface 204, generally semi-cylindrical outer surface 205, and inner bore 206, has a plurality of piston bores 207, in this case three (3), oriented in the radial direction with respect to the piston housing 203. Piston bores 207 all have identical bore profiles and are spaced at even radial intervals, in this case sixty (60) degrees from one another, in a radial plane at the centre-point of the external piston crimping tool 200. Piston bore 207 with cylindrical outer end 208 and cylindrical inner end 209, has an outward facing shoulder 210 separating cylindrical sections 208 and 209.

Referring again to FIG. 11, piston housing 203 has a plurality of female guide splines 214, in this case (2), and an identical number of male guide splines 215 on lower surface 204. The guide splines 214 and 215 run parallel to the piston housing axis. The guide splines, 214 and 215, are located on the lower surface 204 of the piston housing 203, they mate with the opposite guide splines on the other piston housing. The guide splines 214 and 215 are integral to the piston housing 203 in this embodiment of the design, which eliminates the need for a separate joining component. The male guide splines 215 have upper face 216, lower face 217 and two (2) profiled tapered faces 218. The female guide splines 214 have upper face 219, lower face 220, and two (2) profiled tapered faces 221 which mate with the corresponding faces on the male spline 214 of the other piston housing 203.

Figure 12:
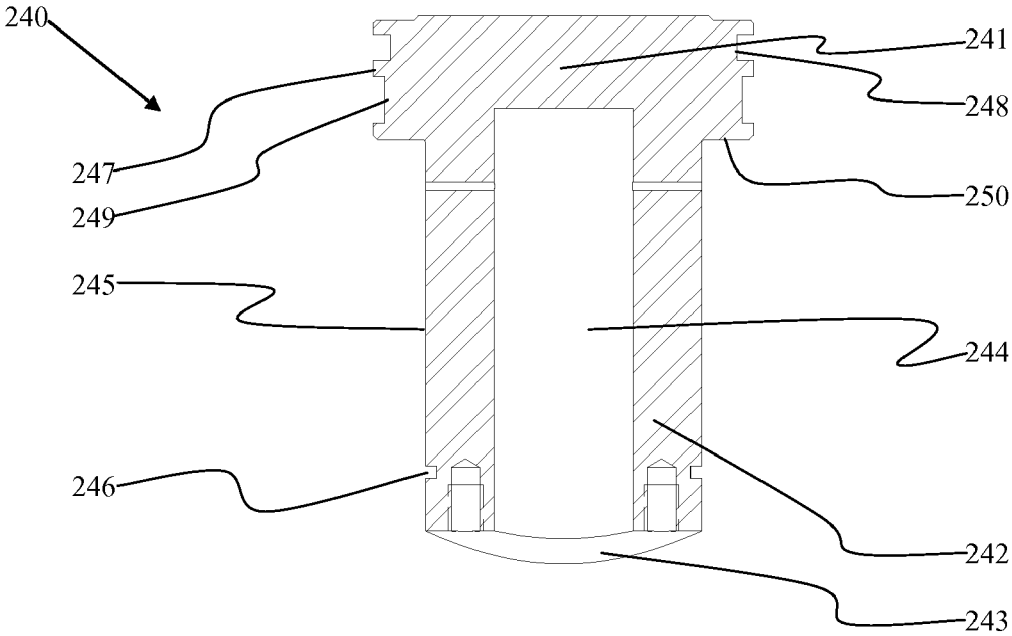
FIG. 12 is a cross-section view of a piston, for use with the crimping tool with externally located pistons.

Referring again to FIG. 10, the external piston crimping tool's 200 crimping assembly has a plurality of piston assemblies, in this case six (6) identical assemblies, each of which includes the following components: piston 240, die 260, can stud 270, piston cap 280, and spring 291. In this case the piston assemblies are arranged in a plane at the centre-line of the tool spaced at even radial intervals, in this case sixty (60) degrees from one another. It is understood that the piston assemblies are not limited to being identical and evenly spaced, and that in the preferred embodiment of the invention the size and spacing of the piston assemblies may be varied within a crimping tool to accommodate circumferential variations in the required applied load distribution to a work piece. Piston assemblies are coaxially located in piston bore 207 of piston housing 203. Referring now to FIG. 12, a cross-section of piston 240 used in the external piston crimping tool 200, piston 240, with upper end 241 and lower end 242, has a cylindrical lower face 243, and inner bore 244, has generally cylindrical outer face 245 on its lower end 242 which contains seal 246. Outer end 241 of piston 240 has a generally cylindrical section 247 which contains seal 248 and wear band 249. Separating the generally cylindrical upper and lower sections of piston 240 is downward facing shoulder 250.

Referring again to FIG. 10, the can stud 270 with lower end 271 and upper end 272, is generally cylindrical in shape with a radial step. A generally cylindrical outside surface 273 at lower end 271 threadingly engages the cylindrical face 212 in piston bore 207 of piston housing 203. The bottom face 274 of can stud 270 lands on outward facing shoulder 210 of piston bore 207 in piston housing 203. Can stud 270 also has upward facing shoulders 275 and 276, generally cylindrical section 277 and upper face 278.

Figure 9:
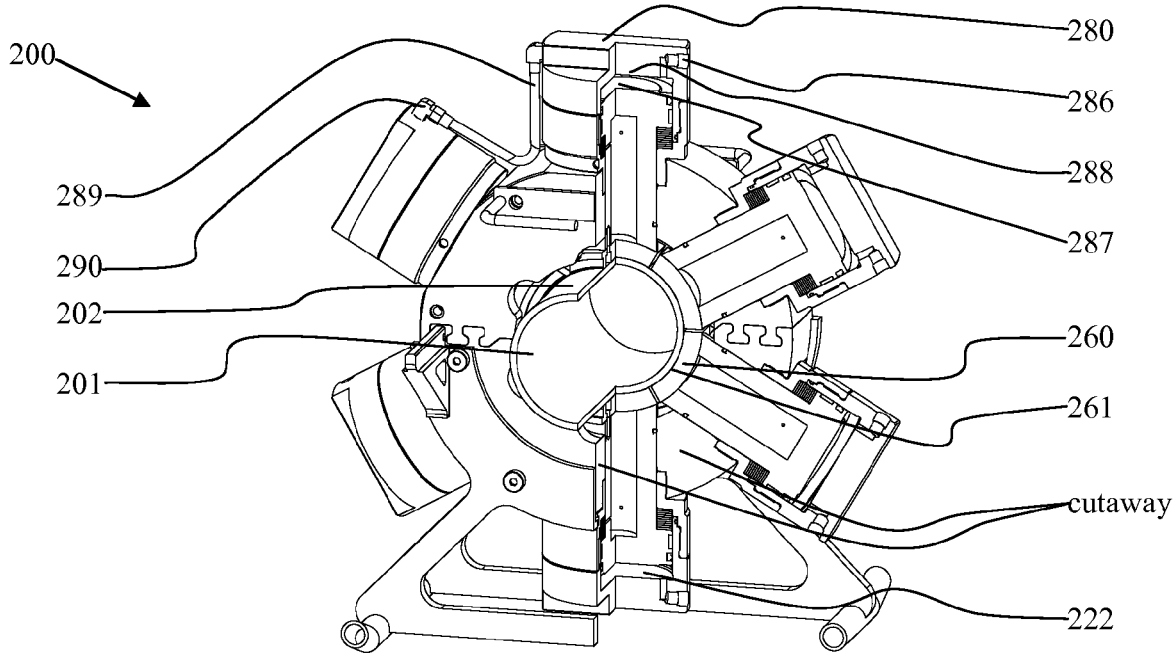
FIG. 9 is an isometric partial cutaway view of the crimping tool with externally located pistons, shown in its engaged position as it would appear with fluid pressure applied, causing dies to engage a work piece.

Referring still to FIG. 10, the piston cap 280 is generally tubular in shape with a plate 281 at the upper end. Generally cylindrical outside surface 282 at the lower end 283 of piston cap 280 threadingly and sealingly engages the generally cylindrical section 277 on the upper end 272 of can stud 270. The generally cylindrical inside surface 284 at the lower end 283 of piston cap 280 sealingly engages with seal 248 on the upper end 241 of piston 240. The plate 281 at the upper end 285 of piston cap 280 contains two (2) hydraulic fluid ports 286. Referring now to FIG. 9, hydraulic fluid ports 286 in piston cap 280 allow access to fluid chamber 287. Fluid in chamber 287 reacts between the downward oriented face 288 of piston cap 280 and the upper face 251 of piston 240 to provide inward radial movement of piston 240 and die 260. Hydraulic tubing and fittings 289 and 290 respectively provide interconnectivity and pressure equalization between all fluid chambers 222. It is understood that the external piston crimping tool is not limited to this arrangement of hydraulic tubing and fittings, alternatively independent hydraulic tubing could be run to each of the piston caps 280 which would allow for independent control of fluid pressure in each fluid chamber as may be desirable for a given application.

Referring now to FIG. 10, generally cylindrical spring 291 has upper end 292 and lower end 293. Upper end 292 of spring 291 reacts against downward facing shoulder 250 of piston 240, while lower end 293 of spring 291 reacts against upward facing shoulder 275 of can stud 270 to provide radial outward force and movement to the piston 240 and die 260. (The springs are shown in all figures as a Belleville washer stack that provides a continually increasing load with axial compression, but are they not limited to this design).

Referring still to FIG. 10, die 260 with a general sectioned tubular shape has inner cylindrical face 261 and outer cylindrical face 262. Outer cylindrical face 262 is rigidly attached to the lower cylindrical face 243 of piston 240. Referring now to FIG. 9, activation of the crimping tool with pressure causes the inside cylindrical face 261 of the die 260, to make contact with the outside face 202 of the work piece 201. The inside face 261 of the die 260 is designed to provide a generally uniform contact with the outside surface 202 of the work piece 201 when fluid pressure is applied to fluid chamber 222.

Figure 13:
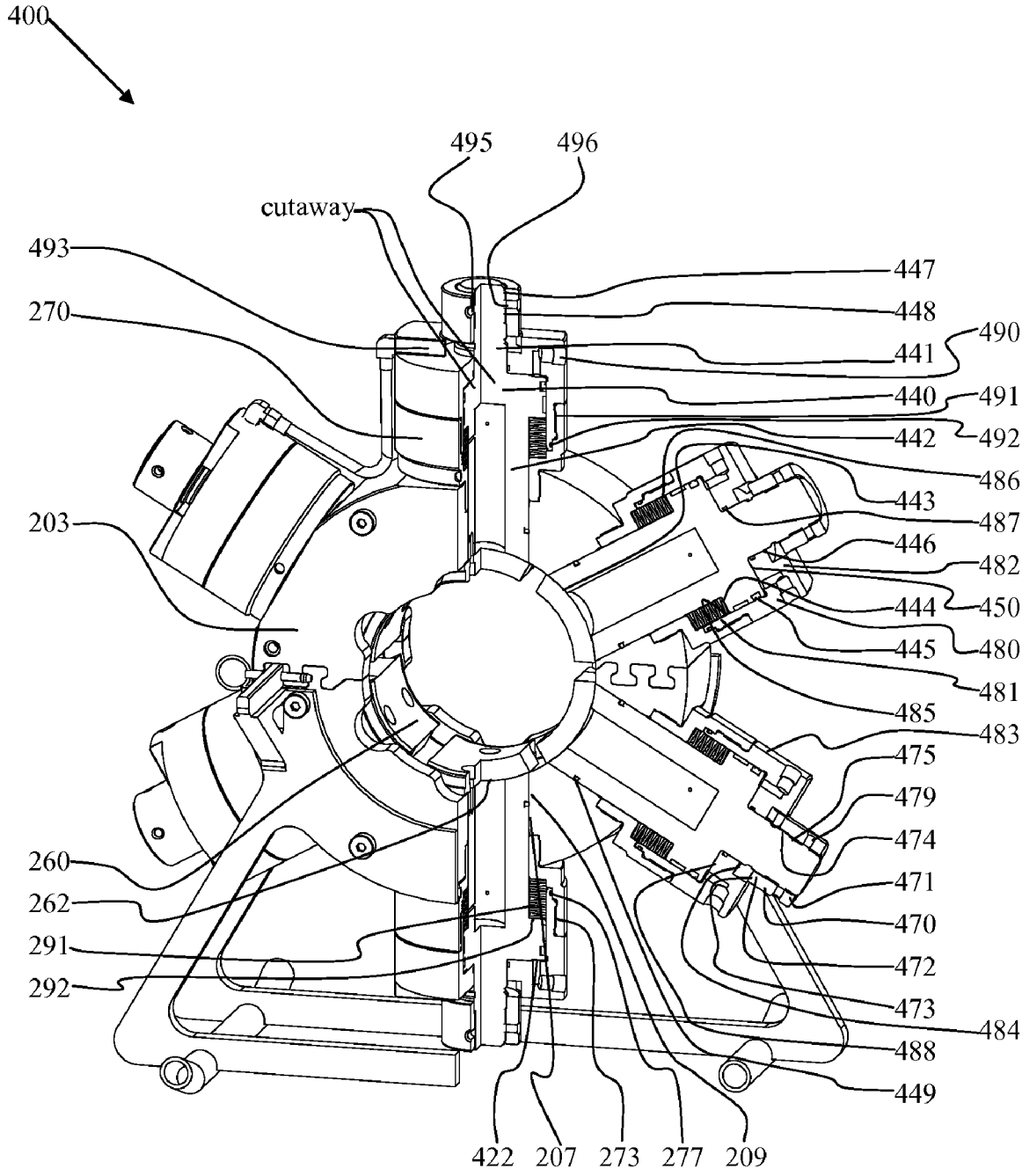
FIG. 13 is an isometric partial cutaway view of an alternative embodiment of a crimping tool with externally located pistons, shown in its retracted position as it would appear with no fluid pressure applied, and including a variable radial piston displacement control.

Alternative Embodiment of the External Piston Radial Tubular Forming Load Controlled Crimping Tool with Variable Radial Displacement Control Referring to FIG. 13, an alternative preferred embodiment of the crimping tool is shown that provides enhanced load capacity and piston stroke in combination with variable radial piston displacement control. This tool will be referred to here as an external piston crimping tool with displacement control. It is shown in FIG. 13 and generally referred to by the numeral 400. Referring now to FIG. 13, the external piston crimping tool with displacement control is shown in its retracted position as it would appear with no fluid pressure applied. This embodiment of the crimping tool has piston housings 203, can stud 270, die 260 and spring 291 in common with external piston crimping tool generally referred to by numeral 200 and illustrated in FIGS. 8 through 12.

Referring still to FIG. 13, this embodiment of the crimping tool has a plurality of pistons 440, in this case six (6), which are generally cylindrical in shape with a stepped profile. Piston 440, with upper end 441 lower end 442, has lower cylindrical face 443, downward facing shoulder 444, upward facing shoulder 450 and seal 445. The lower end 442 of piston 440 has seal 449. The upper end 441 of piston 440 has a smooth face 446, thread element 447 and slot 448 which is aligned with the axis of the piston and intersects thread element 447. Piston 440 is assembled coaxially with spring 291 such that the upper end 292 reacts against downward facing shoulder 444. Lower cylindrical face 443 of piston 440 is rigidly attached to outer face 262 of die 260. Seal 449 on the lower end 442 of piston 440 slidingly and sealingly engages cylindrical inner surface 209 of piston bore 207 in piston housing 203.

Referring still to FIG. 13, this embodiment of the crimping tool has piston nut 470 with upper end 471, lower end 472 and downward facing shoulder 473, which serves as a radial stop. Upper end 471 of piston nut 470 has a plurality threaded holes 479, in this case four (4), which are equally spaced in a radial plane. Piston nut 470 has internal bore 474, with thread element 475. Thread element 447 of piston 440 threadingly engages with thread element 475 of piston nut 470.

Referring still to FIG. 13, the piston cap 480 is generally tubular in shape with a stepped profile. Piston cap 480, with lower end 481 and upper end 482, has outer surface 483 and upward facing shoulder 484. Internal bore 485 of piston cap 480 has generally smooth face 486 at lower end 481 and seal 487 at upper end 482 which are separated by downward facing shoulder 488. Outer surface 483 of piston cap 480 has fluid ports 490 at upper end 482, thread element 491 and seal 492 at lower end 481. Piston cap 480 has parallel torque reaction faces 493 at upper end 482. The upper end 441 of piston 440 is assembled coaxially in the internal bore 485 of piston cap 480, internal bore of stud can 270 and piston bore 207 of piston housing 203. Thread element 491 of piston cap 480 threadingly engages with surface 273 of can stud 270, while seal 492 of piston cap 480 sealingly engages with surface 277 of can stud 270. Seal 487 of piston cap 480 sealingly and slidingly engages face 446 of piston 440. Seal 445 of piston 440 slidingly and sealingly engages surface 486 of piston cap 480.

Referring still to FIG. 13, fluid chamber 422 is formed between the outward facing shoulder 450 of piston 440 and the inward facing shoulder 488 of piston cap 480. A threaded screw 495 threadingly engages one of the threaded holes 479 on the upper end 471 of piston nut 470. The inward facing end 496 of threaded screw 495 engages slot surface 448 of piston 440 to prevent relative rotational movement between piston 440 and piston nut 470. By removing threaded screw 495 and adjusting the position of piston nut 470 up or down along the axis of piston 440 and then reassembling threaded screw 495, the axial displacement of the piston 440 can constrained in increments related to the pitch of thread element 447 and the number of threaded holes 479, such that when pressure is applied to fluid chamber 422 the radial displacement of piston 440 is restricted as downward facing shoulder 473 of piston nut 470 comes into contact with upward facing shoulder 484 of piston cap 480 and reacts the pressure load on piston 440.

What is claimed is:

1. A crimping tool comprising:

a split housing assembly made from a suitably strong and rigid material having a central passageway to accommodate a tubular work piece, the split housing having at least two main body components, the main body components including a structurally rigid joining mechanism, the rigid joining mechanism enabling the at least two main body components of the split housing to be separately placed around a tubular work piece and joined to form a generally short thick-walled cylindrical frame enclosing or encircling the work piece, the joining mechanism also enabling the split housing to be separated and removed from the work piece, wherein the rigid joining mechanism is configured to join the at least two main body components solely by providing keys and keyways which preclude pivotal movement of the main body components, the keyways receiving the keys in an interlocking engagement which is separable by relative movement of the main body components in a substantially axial direction as defined by the work piece and resists separation in other directions;

a crimper assembly carried by the housing assembly, the crimper assembly having three or more jaws arranged to radially extend and retract, the jaws each carrying a discrete portion of a crimping surface generally shaped to conform to the work piece and positioned to radially engage the outside surface of the work piece when the split housing is placed around the work piece and joined;

the crimping assembly having means to apply a selected proportion of radial force to each of the jaws, correlatively providing proportionally distributed radial inward crimping load to the crimping surface, where the number of jaws can be selected to distribute portions of the crimping surface to accommodate non-axi-symmetric features of the work piece, and the distribution of force can be selected to arrange for controlled radially distributed loading of the jaws.

2. The crimping tool of claim 1, wherein the means to apply a selected proportion of radial force to each of the jaws comprises a radial stop to limit radial displacement of the jaw.

3. The crimping tool of claim 2, wherein the position of the radial stop relative to the jaw is adjustable.

4. The crimping tool of claim 1, wherein spring members are provided biasing the jaws to a radially extended position.

5. The crimping tool of claim 1, wherein the means to apply a selected proportion of radial force to each of the jaws comprises means to apply an even distribution of force.

6. The crimping tool of claim 1, wherein the means to apply a selected proportion of radial force to each of the jaws comprises means to apply an uneven distribution of force.

7. The crimping tool of claim 1, wherein the keys are formed on one of the main body components and the keyways are formed on another of the main body components, with separation of the main body components being effected by relative axial movement of the main body components.

8. The crimping tool of claim 1, wherein the keys are formed on the main body components and the keyways are formed on a cooperating locking body forming part of the rigid joining mechanism.

* * * * *